US009149860B2

(12) United States Patent
Dohmann et al.

(10) Patent No.: US 9,149,860 B2
(45) Date of Patent: Oct. 6, 2015

(54) DIE FOR FORGING

(75) Inventors: Jurgen Dohmann, Magdeburg (DE); Christoph Westerkamp, Vechta (DE)

(73) Assignee: THYSSENKRUPP PRESTA AKTIENGESELLSCHAFT, Eschen (LI)

( * ) Notice: Subject to any disclaimer, the term of this patent is extended or adjusted under 35 U.S.C. 154(b) by 340 days.

(21) Appl. No.: 13/812,544

(22) PCT Filed: Jul. 2, 2011

(86) PCT No.: PCT/EP2011/003292

§ 371 (c)(1), (2), (4) Date: Apr. 2, 2013

(87) PCT Pub. No.: WO2012/013284

PCT Pub. Date: Feb. 2, 2012

(65) Prior Publication Data

US 2013/0192330 A1 Aug. 1, 2013

(30) Foreign Application Priority Data

Jul. 26, 2010 (DE) ..... 10 2010 036 609

(51) Int. Cl.
*B21J 13/02* (2006.01)
*B21K 1/76* (2006.01)

(52) U.S. Cl.
CPC ..... *B21J 13/02* (2013.01); *B21J 13/025* (2013.01); *B21K 1/767* (2013.01)

(58) Field of Classification Search
CPC ..... B21J 9/02; B21J 13/02; B21J 13/025; B21K 1/767; B21K 1/768; B21D 17/02; B21D 17/025; Y10T 29/49474; F16H 55/26
See application file for complete search history.

(56) References Cited

U.S. PATENT DOCUMENTS 4,646,554 A 3/1987 Wallis et al.
4,977,773 A 12/1990 Mito et al.
(Continued)

FOREIGN PATENT DOCUMENTS

CN 86101932 A 10/1986
CN 1388331 A 1/2003
(Continued)

OTHER PUBLICATIONS

Search Report, Chinese Patent Application No. 2011800369769, dated May 4, 2014, 2 pgs.

*Primary Examiner* — Debra Sullivan
(74) *Attorney, Agent, or Firm* — Volpe and Koenig, P.C.

(57) ABSTRACT

A die for forging a toothed section of a gear rack of a steering device, including a first die part (9) having a first molding recess (11) for molding the toothing and a second die part (10) having a second molding recess (12), which has the shape of the back area of the gear rack opposite the toothing. The die parts (9, 10) can be moved toward each other in a closing direction (13) into an end position, in which the die parts have a distance (s) from each other, wherein a main cavity (14) is formed between the die parts (9, 10) in a region of the molding recesses (11, 12) of the die parts (9, 10), the main cavity being open on opposite sides to secondary cavities (16, 17), which lie in respective regions between the first and second die parts (9, 10). The die further includes at least two secondary molding parts (18, 19), which lie in respective regions between the first and second die parts (9, 10) and which at least partially form the walls that bound the secondary cavities and which can each be moved relative to the die parts (9, 10) in an adjusting direction (29, 30) oriented at an angle to the closing direction (13).

13 Claims, 11 Drawing Sheets

(56) References Cited

U.S. PATENT DOCUMENTS

| | | | | |
|---|---|---|---|---|
| 6,718,813 | B2 | 4/2004 | Yasuda et al. | |
| 7,000,444 | B2 * | 2/2006 | Roeske et al. | 72/344 |
| 2004/0045387 | A1 | 3/2004 | Keller et al. | |
| 2005/0115298 | A1 | 6/2005 | Brenner | |
| 2007/0079643 | A1 * | 4/2007 | Dohmann et al. | 72/353.2 |

FOREIGN PATENT DOCUMENTS

| | | | |
|---|---|---|---|
| CN | 1642673 | A | 7/2005 |
| DE | 3202254 | C2 | 7/1983 |
| DE | 10341266 | A1 | 5/2004 |
| DE | 102007047827 | A1 | 5/2009 |
| EP | 738191 | B1 | 10/1996 |
| EP | 1007243 | B1 | 3/2004 |
| JP | 58013431 | A | 1/1983 |
| JP | 5177291 | A | 7/1993 |
| JP | 5200475 | A | 8/1993 |
| WO | 95/16529 | A1 | 6/1995 |
| WO | 0168434 | A2 | 9/2001 |
| WO | 2005053875 | A1 | 6/2005 |
| WO | 2006072186 | A1 | 7/2006 |
| WO | 2008138033 | A1 | 11/2008 |

* cited by examiner

DIE FOR FORGING

BACKGROUND

The invention relates to a die for forging a toothed portion of a toothed rack of a steering device, comprising first and second die parts, of which the first die part has a first molding recess for molding the toothing of the toothed rack, and the second die part has a second molding recess, which has the form of the back region of the toothed rack, lying opposite the toothing, and which can be moved together in a closing direction from an open position into an end position, in which they are at a distance from one another, while shaping a blank placed into the die, wherein, in the region of the molding recesses of the die parts, there is formed between the die parts a main cavity, which in the moved-together end position of the die parts is open on opposite sides toward secondary cavities, which respectively lie in a region lying between the first and second die parts. The invention also relates to a forging method for forging a toothed portion of a toothed rack for a steering device, wherein a blank is shaped between two die parts, of which the first die part has a first molding recess for molding the toothing of the toothed rack, and the second die part has a second molding recess, which has the form of the back region of the toothed rack, lying opposite the toothing, and which can be moved together in a closing direction from an open position into an end position, in which they are at a distance from one another, while shaping the blank placed into the die, wherein, in the region of the molding recesses of the die parts, there is formed between the die parts a main cavity, which in the moved-together end position of the die parts is open on opposite sides toward secondary cavities, which respectively lie in a region lying between the first and second die parts, and wherein, when the die parts move together, material of the blank is displaced into the secondary cavities.

Toothed racks for steering devices of motor vehicles that have constant toothings are often produced by machining, allowing a high degree of precision to be achieved. Such toothed racks may also be produced with sufficient accuracy by shaping. Shaping methods are often more cost-effective than machining methods. Toothed steering racks with variable toothing, in which the spacing of the teeth and/or the form of the teeth and/or the inclined position of the teeth changes over the extent of the toothing, are very difficult to produce. For cost-effective mass production, the methods of production become more complex.

Toothed steering racks which have a triangular cross section or a Y cross section in the region of their toothed ends are known. For example, such a toothed rack is disclosed by EP 0 738 191 B1 and the production of this toothed rack is performed by hot forging. Such toothed racks are well suited for variable toothings and are supported in their guidance against the influence of rolling moments that occur due to contact forces between the teeth of the pinion and the teeth of the toothed rack as a result of inclined positions by their longitudinal guidance. Toothed steering racks with a round back profile or D cross section also exist. Such toothed racks have some advantages over toothed racks with a Y cross section in production, including in their non-toothed regions, and in the fitting and sealing of the toothed rack. The required installation space is also significantly smaller and the geometry of the thrust piece mounting the toothed rack is simpler. However, these toothed racks are more susceptible to the influence of rolling moments, which can cause canting and associated noise (rack roll). For producing toothed racks, in particular round-back toothed racks, for steering devices by shaping techniques, forging methods with flash and forging methods without flash are known.

In the case of a forging method with flash, in which a die of the type mentioned at the beginning is used, when the two die parts are moved together, material of the blank is forced out of the main cavity into secondary cavities lying on both sides of the main cavity in the region of the parting plane between the die parts and this material forms flash, which is removed after the forging operation. This flash also makes up for volume tolerances of the blank. When the die parts are moved together, the opening of the main cavity toward the secondary cavities is continuously reduced (this is also referred to as the "die gap"), the internal die pressure increasing and parts of the material flowing from the main cavity into the secondary cavities. Particularly at the edges, there is a strong flow of the material of the blank under high pressure. This leads to great wear on the die parts, in particular at the edges of the die parts that bound the main cavity toward the secondary cavities. The die parts therefore have short service lives. Furthermore, the achievable toothing accuracies are limited. These also depend on the die gap geometry, which can be changed only by reworking the die parts themselves.

EP 1 007 243 B1 discloses a forging method with flash for producing round-back toothed racks with flash, the secondary cavities bounding the flow of the material of the blank from the main cavity. The total volume of the secondary cavities in the end position of the die parts corresponds in this case to the difference in volume between the toothed rack blank and the finished toothed rack in the toothed region. Consequently, in the end position of the die parts, the secondary cavities are closed and completely filled with material of the blank. As a result, an increased hydrostatic final pressure can be formed. One disadvantage of this method is that the volume of the blank has to be defined very accurately, and so it must be exactly pre-ground, or produced in some other way. This increases the complexity of the production considerably.

WO 2005/053875 A1 discloses a forging method without flash for producing round-back toothed racks. Two punches are provided between the two die parts. In the closed state of the two die parts, these parts abut against the two punches on both sides. At this point in time, the main cavity is not yet completely filled with the material of the blank. Thereafter, the two punches are forced into the main cavity, reducing the volume of the main cavity, whereby the material of the blank is pressed on all sides against the walls of the main cavity. The die that is used in this method, and is not of the generic type concerned here, consequently does not have any secondary cavities. Also in the case of this method, the volume of the blank must be accurately defined. Therefore, in the region of the toothed rack in which the toothing is formed there is formed a preform, which is reduced by the proportion of the volume that would occur in the case of production by machining. It has also been found that, in order to obtain a pleasing result, a geometrical shaping of the preform that approximates to the final form is generally required. The geometry of the preform must be empirically determined here, which is technologically complex. Moreover, the production of the preform causes significant additional costs, due to the machining itself and due to the requirements applying to the volume accuracy. Furthermore, the process control is complex and even minor deviations in the volume of the preform or in the volume of the main cavity may lead to the formation of flash, thereby generating further additional costs as a result of the reworking required.

SUMMARY

The object of the invention is to provide a die and a forging method of the type mentioned at the beginning by which improved production of a toothed rack for a steering device is made possible. This is achieved by a die with the features of the invention and by a forging method with the features of the invention. Advantageous developments are described below and in the claims.

The die according to the invention has an open main cavity, wherein, in the moved-together end position of the two die parts, the main cavity that is formed in the region of the molding recesses between the die parts is adjoined on both sides by secondary cavities. When the die parts move together, the secondary cavities are entered by material of the blank, whereby lateral bulges or flash are formed. According to the invention, the die has in addition to the two die parts at least two secondary molding parts. These are respectively located in the region that lies between the first and second die parts, and the walls that bound the secondary cavities are at least partly formed by the secondary molding parts. The secondary molding parts are respectively displaceable here with respect to the die parts in an adjusting direction that is oriented at an angle to the closing direction. The angle which the adjusting direction of the respective secondary molding part forms with the closing direction favorably lies in an interval from 45° to 135°, angles in the range from at least 70° to 110° being preferred and a right angle to the closing direction being particularly preferred.

The forging method according to the invention for forging a toothed portion of a toothed rack is characterized by the features of claim 11. The material displaced into the secondary cavities abuts against secondary molding parts, which respectively partially bound the flow of the displaced material in the respective secondary cavity. The material displaced into the respective secondary cavity is displaced into an intermediate space, which is arranged within the respective secondary cavity (i.e. forms part of the respective secondary cavity) and is bounded by a face of the respective secondary molding part that is directed in the direction of one of the die parts and the end face of the die part or by a face of the respective secondary molding part that is directed in the direction of one of the die parts and a surface of a further secondary molding part, which is arranged in the same secondary cavity. The respective intermediate space therefore lies between the respective secondary molding part and one of the die parts or between two respective secondary molding parts that respectively partially bound the same secondary cavity.

The forging method according to the invention makes it possible to combine a free shaping (that is a shaping that is only partially restricted to walls of the die or in other words is partially unrestricted) and a mold-bound shaping of the material of the blank into the secondary cavities. The flow of material into the secondary cavities is necessary to achieve the shaping of the desired form of the toothed rack, and thereby reduce the preliminary work for preforming blanks.

Being formed in this way makes it possible for the secondary molding parts to be positioned in a defined manner, adjusted with increasing wear or exchanged. As a result, an exchange or reworking of a die part can be avoided, or at least delayed.

Furthermore, the geometry of the secondary cavities is at least co-determined by the secondary molding parts. The geometry and/or setting of the secondary molding parts consequently allows the geometry of the secondary cavities to be changed or adapted, whereby the flow of material of the blank during the forging can be optimized. Improvements in the quality of the completed toothed rack can be achieved as a result. In particular, the flow resistance for the displaced material of the blank can be set, allowing tooth shaping at lower pressures to be achieved, at least over part of the feed path of the die parts, which in turn has a favorable effect on the service life. Moreover, the risk of cracks forming in the toothed rack can be reduced.

In the moved-together end position of the die parts, the secondary cavities are advantageously not filled completely with the material of the blank, i.e. there are in any event regions that have not been reached by the material of the blank. The secondary cavities are preferably open toward the outside here. That is to say that the secondary cavities are not only open toward the main cavities, but are also not bounded by a wall at at least one further location. However, a forming of the secondary cavities that is "open" in the sense mentioned would also be obtained if the secondary cavities were not closed toward the outside in the end position of the die parts but their volume was so great as to not be filled completely by the displaced material of the blank. In the case of a cylindrical blank that is preferably used, the volume of the secondary cavities together is consequently greater than the proportion of the volume of the blank that would have to be removed in the case of production of the toothed rack by machining.

Between a respective secondary molding part and an end face of one of the die parts that is facing the other of the die parts, or between two secondary molding parts that respectively bound portions of the same secondary cavity, there is favorably an intermediate space. Its width is reduced when the die parts are moved together. In the moved-together end position, however, this intermediate space still exists, i.e. it is not completely closed, its width in the moved-together end position (measured in the closing direction) preferably being at least 2 mm.

The flow of material can be controlled by the secondary molding parts in such a way that, although the secondary cavities are not completely filled with material, the flow stresses that are required for the shaping of the toothing are achieved. Nevertheless, the workpiece blank has to be formed less precisely than in the case of the prior art, since fluctuations in the amount of material can be compensated to the greatest extent by the free space in the secondary cavity.

An advantageous embodiment of the invention provides that a respective secondary molding part has first and second side faces, of which the first side face abuts against an end face of one of the two die parts, which is facing the other die part, and at least a portion of the second side face forms a wall bounding the respective secondary cavity. The first and second side faces of the secondary molding part are connected to one another by way of an end face. This end face favorably forms an angle of less than 45°, preferably less than 20°, with the closing direction, a parallel alignment with the closing direction being particularly preferred. The end face of a respective secondary molding part is preferably drawn back from the main cavity, that is to say does not protrude into the main cavity or does not finish flush with it, but rather forms a wall bounding the secondary cavity against which material of the blank coming out from the main cavity abuts when the die parts are moved together.

The end face is advantageously set back from the main cavity by at least a tenth, preferably at least a fifth, of the distance between the die parts in their end position. Here there extends between the end face and the main cavity a portion of the end face (lying next to the molding recess) of the die part against which the secondary molding part abuts, the extent of this portion of the end face of the die part, seen in cross section through the die (which is aligned at right angles to the longitudinal extent of the toothed rack or of the main cavity), being at least a tenth, preferably at least a fifth, of the distance between the end faces of the die parts (measured in regions next to the molding recesses) in their moved-together end position.

The thickness of the secondary molding parts (measured in the closing direction) is favorably at least a quarter, preferably at most three quarters, of the distance between the mutually facing end faces of the die parts (in their portions lying next to the molding recesses) when the die parts assume their moved-together end position.

An advantageous variant of an embodiment of the method according to the invention provides that, during the forging of the toothed portion of the toothed rack, the secondary molding parts are kept stationary with respect to their adjusting directions, that is to say there is no movement in the adjusting direction, at least from the point in time from which material of the blank abuts against the secondary molding parts. The secondary molding parts are kept stationary here with respect to one of the two die parts; preferably it is only on the fixed die part that secondary molding parts are held, and are consequently stationary with respect to said fixed part during the forging.

In another possible embodiment of the method according to the invention, however, at least one of the secondary molding parts could be adjusted in its adjusting direction during the forging of the toothed portion of the toothed rack. This allows the flow of material to be influenced further. Such an adjustment of at least one of the secondary molding parts, favorably all of the secondary molding parts, may be performed here at the same time as the moving together of the die parts and/or thereafter. A path-controlled traversing of the movement of the secondary molding parts, in which the movement is coupled to the closing movement of the die parts by corresponding wedge and/or slotted-link guides, is in this case conceivable and possible. Alternatively, one or both of the secondary molding parts may be specifically moved by additional hydraulic rams during the shaping process.

BRIEF DESCRIPTION OF THE DRAWINGS

Further advantages and details of the invention are explained below on the basis of the accompanying drawing, in which.

DETAILED DESCRIPTION OF THE PREFERRED EMBODIMENTS

Figure 1:
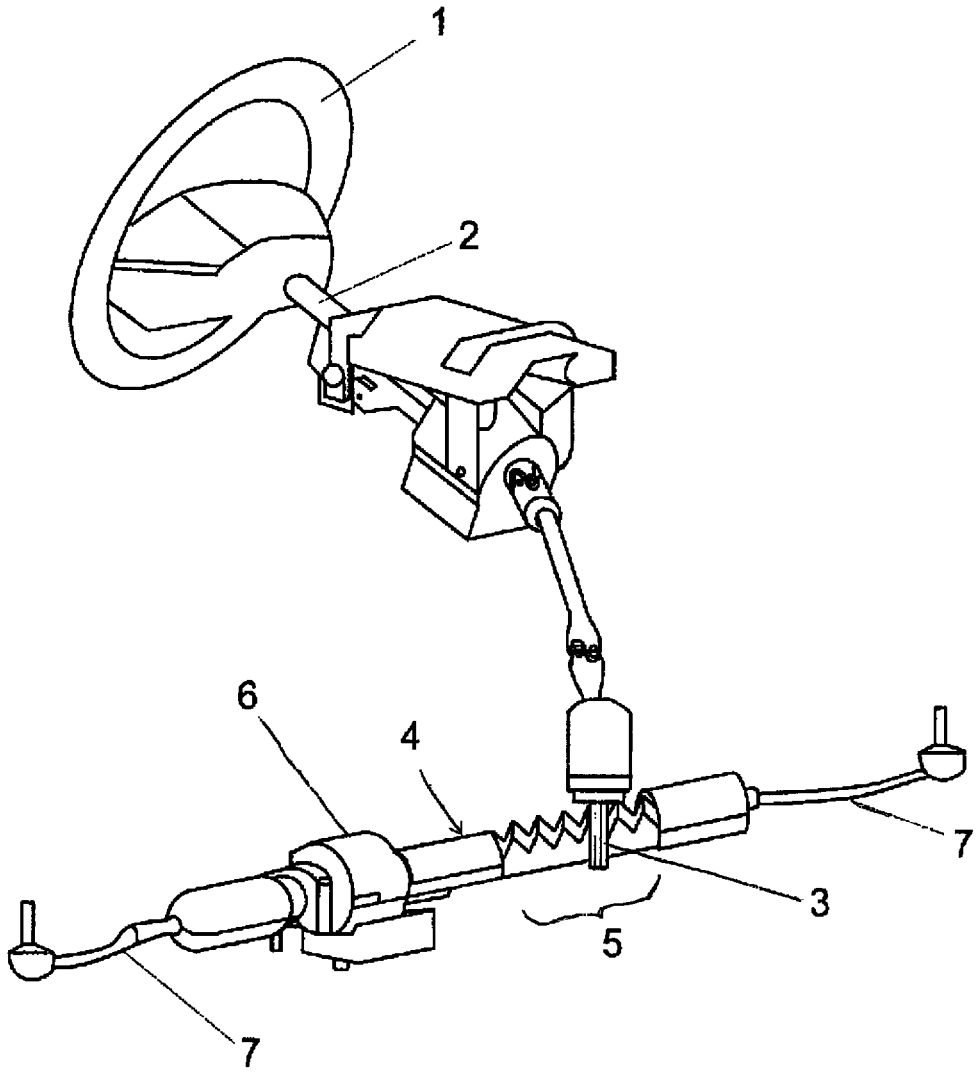
FIG. 1 shows a schematic representation of a steering device for a motor vehicle.

Elements that are the same or act in the same way are designated by the same reference numerals in the figures.

FIG. 1 schematically shows a possible way of forming a steering device for a motor vehicle. The steering device comprises a steering wheel 1 and a steering shaft 2, which comprises two or more portions connected to one another in an articulated manner. Attached or coupled to the steering shaft 2 for rotation therewith is a steering pinion 3, which meshes with a toothed portion 5 of a toothed rack 4. The toothed rack 4 is mounted displaceably in the direction of its longitudinal axis, for example in a steering housing 6. Tie rods are directly or indirectly in connection with the two ends of the toothed rack 4 by way of ball joints that are not represented. The tie rods 7 are each connected to a steered wheel of the motor vehicle in a known manner by way of steering knuckles.

There may be various devices to assist the driver in the steering movement, for example auxiliary drives acting on the toothed rack 4 or auxiliary drives acting on the steering shaft 2.

Figure 2:
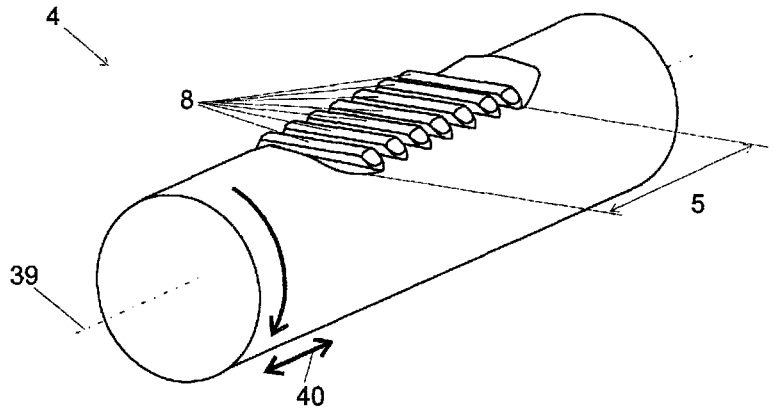
FIG. 2 shows a perspective view of a portion of the toothed rack of the steering device (the toothed region is shown in a shortened and simplified form)

An enlarged portion of the toothed rack 4 is represented in a perspective view in FIG. 2. The toothed rack 4 has a toothed portion 5, which for the sake of simplicity is represented in a shortened form in FIG. 2. The toothed portion extends over part of the longitudinal extent of the toothed rack 4 lying parallel to the longitudinal axis 39 of the toothed rack 4. In the installed state, the toothed rack 4 is mounted displaceably in a displacing direction 40 lying parallel to its longitudinal axis 39, which is indicated in FIG. 2 by a double-headed arrow.

The teeth 8 of the toothed portion are represented in FIG. 2 as straight toothing 5 with the same spacings and the same tooth forms. It is often intended to use tooth geometries deviating from this, it being possible for helical toothings to be provided. The spacings of the teeth and/or their inclined positions and/or their forms can be varied here by way of the extent of the toothed portion, reference then being made to toothed racks that are variably toothed.

In the exemplary embodiment shown, the region of the toothed rack 4 lying diametrically opposite the toothing 5 is cylindrically formed. A toothed rack for a steering device that has such a form is also referred to as a round-back toothed rack. In the region lying diametrically opposite the toothing 5 (that is the back region), the contour of the toothed rack 4 is consequently arcuate when seen in cross section. In the region of the toothing 5, the toothed rack is of a flattened form when seen in cross section. With regard to this forming, such a toothed rack is also referred to as a toothed rack with a D profile.

Figure 3:
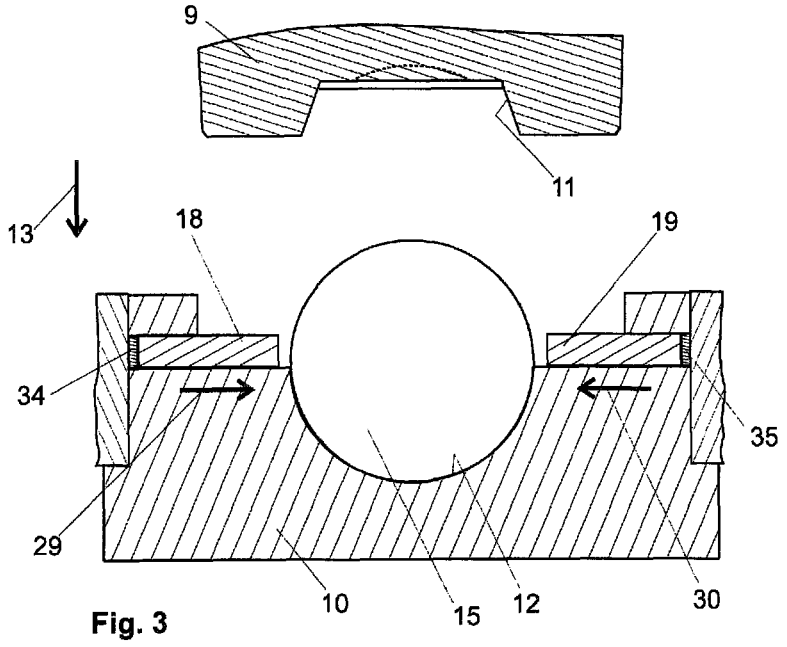
FIG. 3 shows a schematic representation of an exemplary embodiment of a die according to the invention in the open position, with a blank placed in it, in cross section (at right angles to the longitudinal extent of the die or at right angles to the longitudinal axis of the toothed rack)

A die (that is a mold) for forging the toothed portion of the toothed rack is schematically represented in cross section in FIG. 3, in its open position. The die comprises first and second die parts 9, 10. The first die part 9 has a first molding recess 11, which serves for molding the portion having the toothing 5. The second die part 10 has a second molding recess 12. This has the form of the back region of the toothed rack in the toothed portion, lying diametrically opposite the toothing 5, that is to say in the exemplary embodiment is of an arcuate form when seen in cross section at right angles to the longitudinal axis 39.

Figure 5:
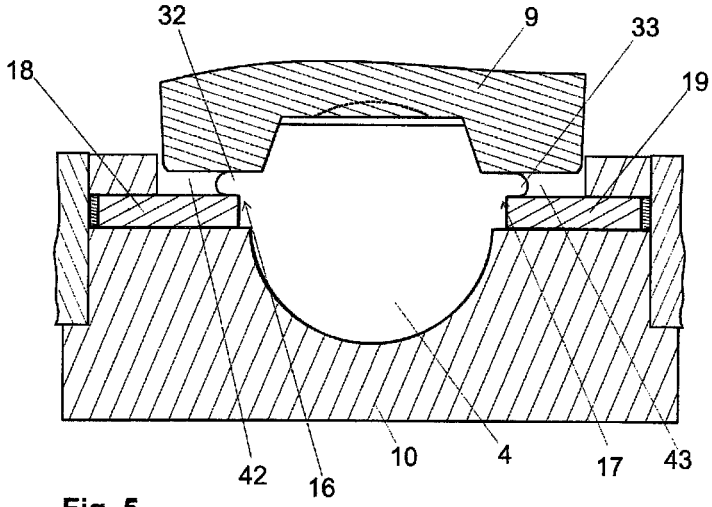
FIG. 5 shows a representation analogous to FIG. 3 in the moved-together end position of the die parts.

In the exemplary embodiment shown, the first die part 9, which has the first molding recess 11, forming the toothing, is movable and the second die part 10 is fixed. The first die part 9 is moved here in the closing direction 13, in the direction of the second die part 10, from the open position until a completely moved-together end position is reached. The moved-together end position is represented in FIG. 5 (with the blank 15 formed into the toothed rack 4) and for further illustration in FIG. 9 (without a blank 15 formed into the toothed rack). A converse way of forming, in which the first die part 9 is fixed and the second die part 10 is adjustable in a closing direction (which is opposed to the closing direction 13), in the direction of the first die part 9, for the molding of the toothed portion of the toothed rack is conceivable and possible.

Figure 9:
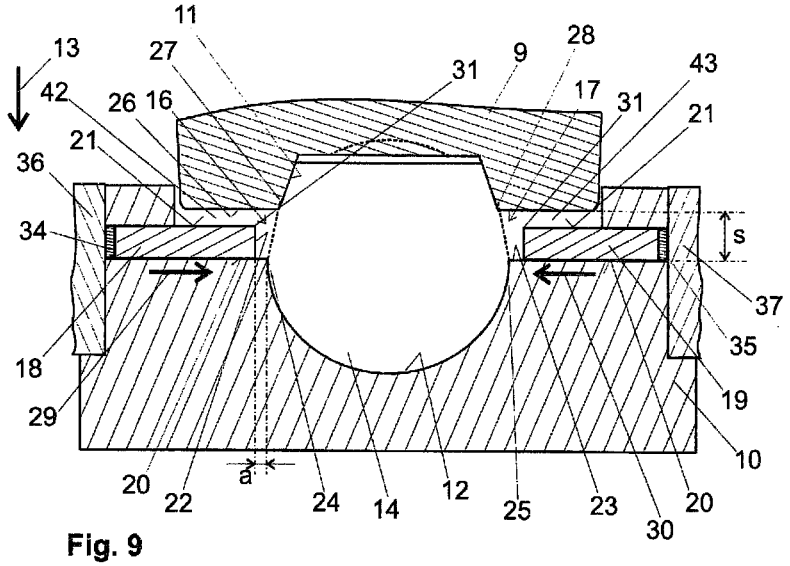
FIG. 9 shows a cross section through the die in the moved-together end position of the two die parts, without the formed toothed rack, for the purposes of illustration.
Figure 10:
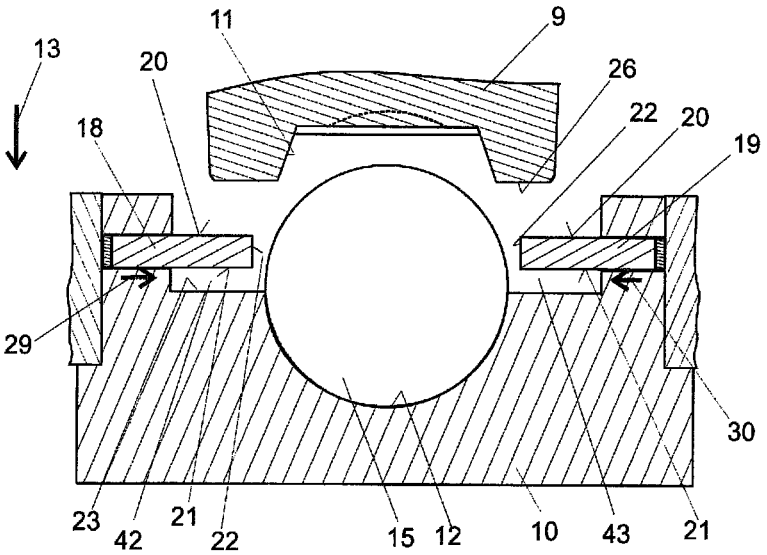
FIGS. 10 to 13 show representations analogous to FIGS. 3 to 6 of a second embodiment of the invention.
Figure 11:
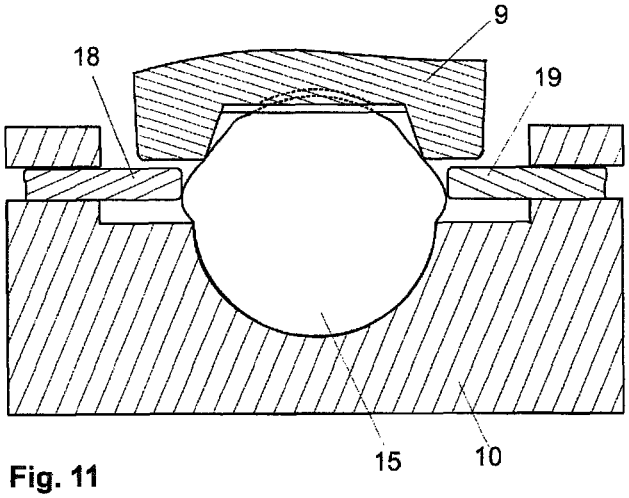
Figure 12:
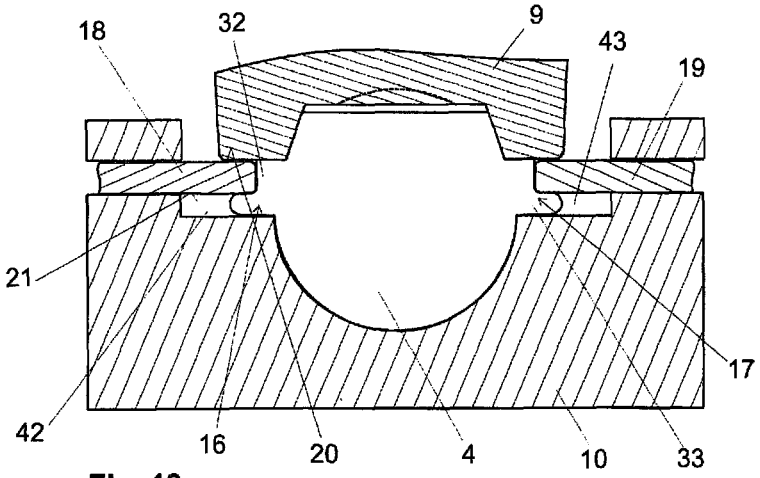
Figure 13:
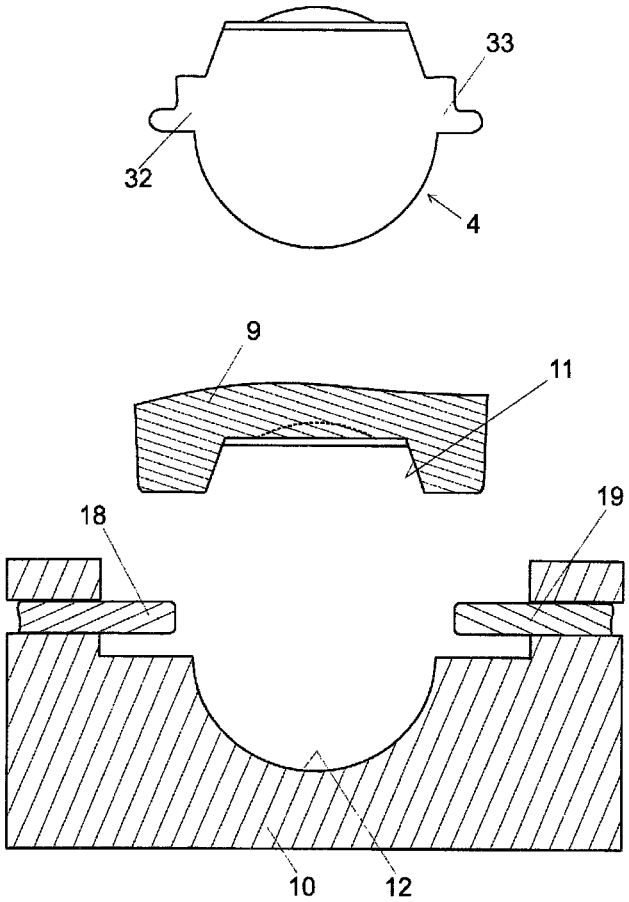

Between the die parts 9, 10, to be precise in the region in which the molding recesses 11, 12 lie, there is formed a main cavity 14, cf. FIG. 9. The main cavity 14 consequently comprises the regions of the molding recesses 11, 12 and also the region between the two die parts 9, 10 that lies between the molding recesses 11, 12. In FIG. 9, this region lying between the molding recesses 11, 12 is delimited schematically by dashed lines from regions lying between the die parts 9, 10 that lie laterally in relation to the molding recesses 11, 12. The delimitations are depicted here in FIG. 9 as running in a straight line between edges at the borders of the molding recesses 11, 12. Instead, the delimitations could also continue the profile—arcuate here—of the second molding recess 12, that is to say be formed in a way corresponding to the cross-sectional contour of the cylindrical blank 15 placed into the second molding recess 12 before its shaping. As seen in cross section (corresponding to FIG. 9), the mold cavity that is bounded by the molding recesses 11, 12 of the two die parts 9, 10 in the position in which the two die parts 9, 10 are moved closest together during the shaping process and also by the lines that are formed by the tangential extensions of the inner contours of the molding recesses 11, 12 of the respective die part 11, 12 beyond the associated edge 27, 28 or 24, 25 up to the point of intersection of these tangential extensions, taken from the two die parts 9, 10, may also be regarded as the main cavity 14. The exact profile of the delimitation, that is to say whether for example the possibility represented in FIG. 9 or the other possibility described is chosen, is unimportant.

The main cavity 14 is consequently open on opposite sides—with respect to a mid-plane lying parallel to the closing direction 13 and passing through the die parts 9, 10 or through the (shaped) blank 15. The main cavity 14 is adjoined here on both sides by secondary cavities 16, 17. The openings between the main cavities 14 and the secondary cavities 16, 17 may also be referred to as "die gaps". The secondary cavities 16, 17 respectively lie within a region that lies between the two die parts 9, 10; to be precise, these regions lie on both sides (with respect to the previously mentioned mid-plane) next to the molding recesses 11, 12.

A separate secondary molding part 18, 19 is also respectively arranged in the regions lying between the die parts 9, 10 and on both sides of the molding recesses 11, 12. A respective secondary molding part 18, 19 has first and second side faces 20, 21 and an end face 22, which is directed toward the main cavity 14 and connects the first and second end faces 20, 21. The first side face 20 of the respective secondary molding part 18, 19 abuts against the end face 23 of the second die part 10 that is directed toward the first die part 9. The opposite, second side face 21 of the respective secondary molding part 18, 19 forms a wall bounding the respective secondary cavity 16, 17. The end face 22 of the respective secondary molding part 18, 19 is drawn back from the respective edge 24, 25, which lies between the end face 23 of the second die part 10 that is directed toward the first die part 9 and the second molding recess 12 of the second die part 10. Here, the distance a of the respective secondary molding part 18, 19 from the respective edge 24, 25 is favorably at least a tenth, preferably at least a fifth, of the distance s that the two die parts 9, 10 or their end faces 26, 23 are from one another. The portion of the end face 23 of the second die part that lies between the respective secondary molding part 18, 19 and the respective edge 24, 25 of the second die part 10 forms a further portion of the walls bounding the respective secondary cavity 16, 17.

A further portion of the walls bounding the respective secondary cavity 16, 17 is also formed by the end face 26 of the first die part 9 that is facing the second die part, these portions of the walls respectively adjoining the edges 27, 28, which lie between the end face 26 of the first die part 9 and the first molding recess 11 of the first die part 9.

A respective secondary molding part 18, 19 is mounted displaceably in the respective adjusting direction 29, 30 with respect to the fixed, second die part 10. In the exemplary embodiment shown, the adjusting directions 29, 30 lie parallel to one another and at right angles to the closing direction 13 and to the longitudinal axis 39. Angular alignments of the adjusting directions 29, 30 with respect to the closing direction 13 and/or with respect to the longitudinal axis 39 are also conceivable and possible, the adjusting directions 29, 30 not having to lie parallel to one another. Deviations from the right-angled alignment to the closing direction 13 and/or to the longitudinal axis 39 of less than 20° are preferred.

In the exemplary embodiment shown, the end faces 22 of the secondary molding parts 18, 19 are planar and lie parallel to the closing direction 13 and parallel to the longitudinal axis 39. The end faces 22 of the opposing secondary molding parts 18, 19 face in the direction of the main cavity 14 and here preferably in the direction of a central region of the toothed rack 4 to be formed.

The end faces 22 could also form an angle that is favorably less than 45°, preferably less than 20°, with the closing direction 13 and/or with the longitudinal axis 39.

The forging of the toothed rack is explained below on the basis of FIGS. 3 to 6.

In the open position of the two die parts 9, 10, the blank 15 is placed into the second molding recess 12 of the fixed, second die part 10, cf. FIG. 3. The blank 15 has here a temperature that is suitable for hot forging. For a blank made of steel, this lies above the recrystallization temperature of steel, preferably between 600° and 1250° Celsius.

In principle, the mold and the method can, however, also be used for cold forging. On account of the high shaping forces and the resultant loads on the mold, however, hot shaping is preferred in the case of shaping steel.

Figure 4:
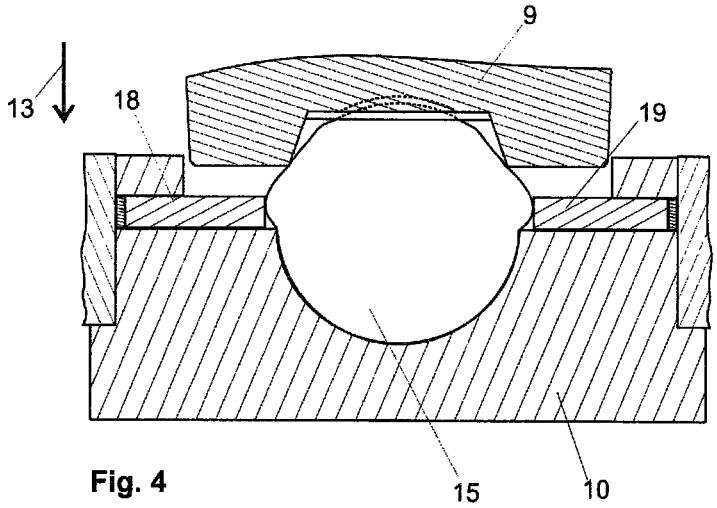
FIG. 4 shows a representation analogous to FIG. 3 during the moving together of the two die parts.

As a consequence, the movable, first die part 9 is moved in the closing direction 13, the blank 15 being shaped, and beginning to flow in the plastified state under the hydrostatic pressure forming, after impingement of the first die part 9. An intermediate position during the moving together of the two die parts 9, 10 is represented in FIG. 4. The shaping of the blank 15 has already commenced and material of the blank has come out into the region of the secondary cavities 16, 17, material of the blank already having run up against the end faces 22 of the secondary molding parts 18, 19.

As the first die part 9 moves further in the closing direction 13, the blank 15 is deformed further and further material of the blank 15 passes into the secondary cavities 16, 17. As the moving together of the die parts 9, 10 continues, material of the blank passes into the respective intermediate space 42, 43 between the second side faces 21 of the secondary molding parts 18, 19 (these second side faces 21 lie opposite the first side faces 20, which abut against one of the die parts 9, 10, here against the second die part 10) and the end face 26 of the first die part 9 (if the secondary molding parts 18, 19 were to abut with their one side face against the first die part 9, the respective intermediate space would lie between the other side face of the respective secondary molding part 18, 19 and the end face 23 of the second die part 10). These intermediate spaces 42, 43 become smaller as the first die part 9 increasingly approaches the moved-together end position of the die parts 9, 10, which is represented in FIG. 5. This results in an increased hydrostatic pressure in the material of the blank 15 in the final phase of the moving together. Under this high pressure, there is furthermore an increased flow of the material of the blank 15 around the edge 31 of the respective secondary molding part 18, 19 that lies between the second side face 21, bounding the gap mentioned, and the end face 22 of the respective secondary molding part 18, 19. These edges 31 are consequently exposed to a relatively increased amount of wear.

Figure 6:
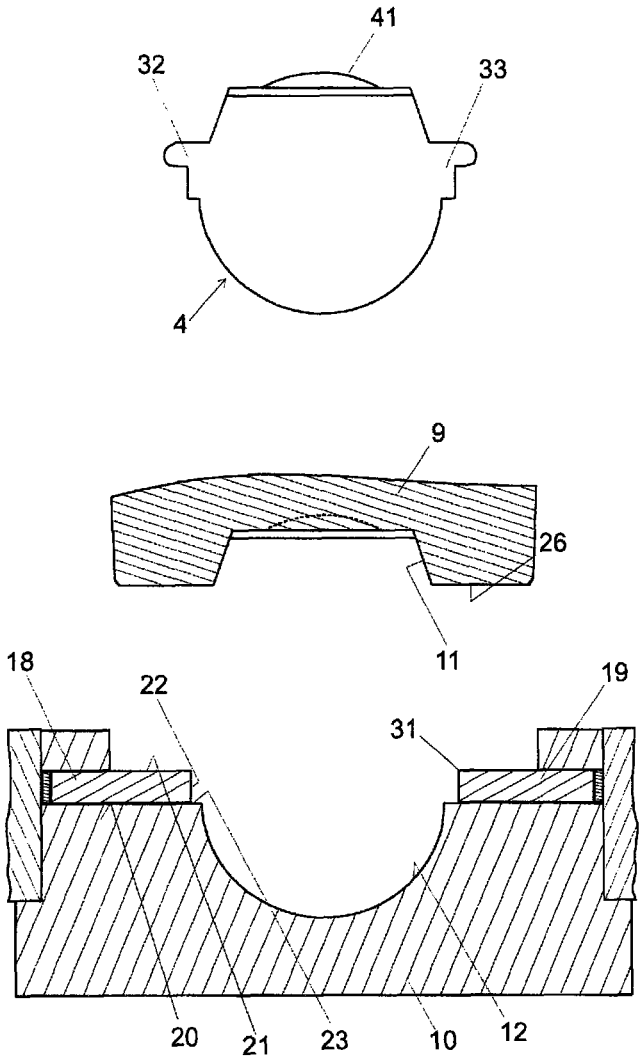
FIG. 6 shows a representation analogous to FIG. 3 after the forging, with the forged toothed rack removed from the die.
Figure 7:
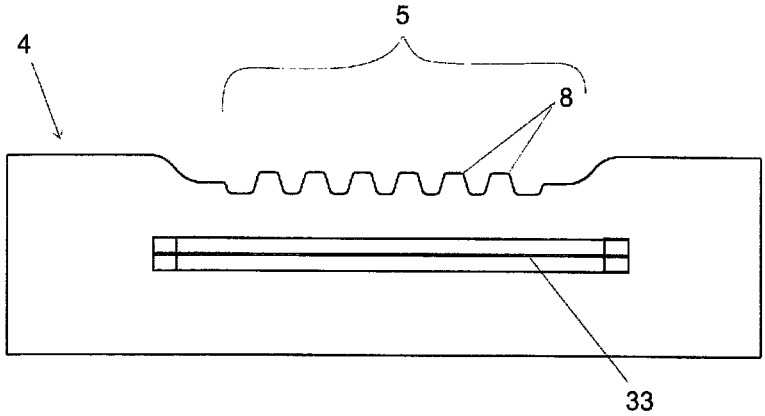
FIGS. 7 and 8 show a side view and a plan view of the toothed rack after the forging.
Figure 8:
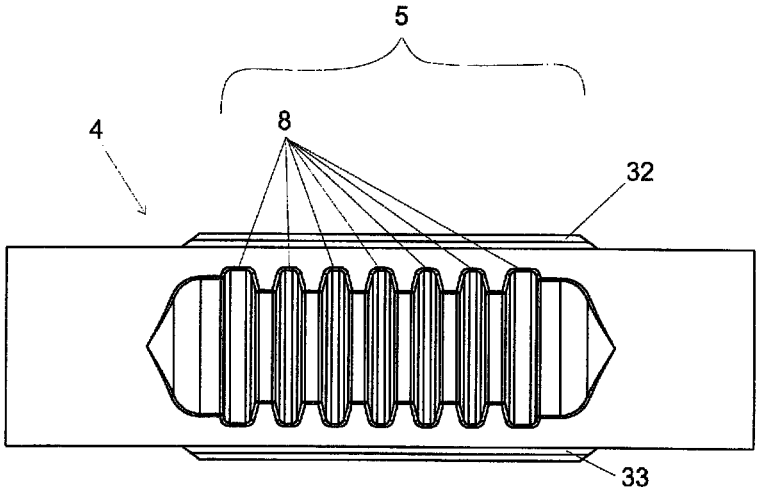

Once the die parts 9, 10 have reached the moved-together end position, cf. FIG. 5, and the method of forging the blank 15 has been completed, the first die part 9 is opened, counter to the closing direction 13, and the toothed rack 4 that has been formed by shaping of the blank 15 is removed from the die, cf. FIG. 6.

In FIG. 6, the arcuate profile 41 in the non-toothed portion of the toothed rack 4 can be seen. The molding recesses 11, 12 of the die parts 9, 10 extend into the non-toothed portion of the toothed rack 4, which is indicated for the die part 9 by a dashed line.

After the forging, the toothed rack 4 still has flash 32, 33 on both sides, which can be subsequently detached.

The secondary molding parts 18, 19 consequently represent at least parts of the geometry of the flash 32, 33. Consequently, they also influence the flow of the material of the blank 15 during the forging operation.

During the method of forging the exemplary embodiment described above, the secondary molding parts 18, 19 remain stationary with respect to the second die part 10. With increasing wear, the secondary molding part 18, 19 can be adjusted by a displacement in the respective adjusting direction 29, 30. When doing so, a stop plate 34, 35, which lies between the end of a respective secondary molding part 18, 19 that is directed away from the main cavity 14 and a respective stop 36, 37, can be exchanged. The stops 36, 37 are stationary with respect to the die part on which the respective secondary molding part 18, 19 is displaceably guided, here that is with respect to the second die part 10.

This adjustment of the secondary molding parts 18, 19 allows the changes in the material flow that are caused by the wear to be at least partially compensated. The service life of the die can be increased as a result.

If the wear on the secondary molding parts 18, 19 has become too great, they can be exchanged in a simple way, without reworking of the die parts 9, 10 themselves being required. The wear occurring on the die parts 9, 10 is much less than the wear occurring on the secondary molding parts 18, 19. In the final phase of the moving together of the die parts 9, 10, in which the hydrostatic pressure is particularly high, a much smaller flow occurs around the edges 24, 25, 27, 28 of the die parts 9, 10.1

It would also be conceivable and possible to form the secondary molding parts 18, 19 such that they are adjustable during the process (between individual forging operations). Corresponding actuators, by which the secondary molding parts 18, 19 can be adjusted in the adjusting directions 29, 30, could be provided for this purpose.

Optimizations of the flow can be performed in a simple way on the device for the forging method. For this purpose, the positions of the secondary molding parts 18, 19 may be changed and/or secondary molding parts with different geometries, for example with respect to their thickness (that is the distance between their side faces 20, 21), may be used. In this way, optimizations of the flow can be carried out without the die parts 9, 10 themselves being worked.

A second exemplary embodiment of the invention is represented in FIGS. 10 to 13. This exemplary embodiment corresponds to the exemplary embodiment described above, apart from the differences described hereafter.

The secondary molding parts 18, 19 are here likewise mounted displaceably in the adjusting directions 29, 30 on the fixed, second die part 10. However, in the moved-together end position of the die parts 9, 10, the one end faces 20 of the secondary molding parts 18, 19 are not abutting against the second die part 10 but against the end face 26 of the first die part 9, cf. FIG. 12. The side faces abutting against the die parts 9, 10 are in turn referred to as first side faces 20. The opposite, second side faces 21 are directed toward the end face 23 of the second die part 10 and are at a distance from it. Between these second side faces 21 and the end face 23 there consequently lies an intermediate space 42, 42, which represents part of the secondary cavities 16, 17 and into which material of the blank 15 flows in the final phase of the moving together of the die parts 9, 10, as can be seen from the comparison of FIGS. 11 and 12.

In this exemplary embodiment, the secondary cavities 16, 17 are not open toward the outside in the moved-together end position of the die parts 9, 10. However, these secondary cavities 16, 17 are only partially filled with the displaced material of the blank 15 in the end position of the die parts 9, 10. In this sense it is likewise possible to speak of "open" secondary cavities or to speak of an "open overall cavity", which comprises the main cavity 14 and secondary cavities 16, 17.

The flash geometries 32, 33 differ from the geometry of the flash 32, 33 of the first exemplary embodiment.

The secondary molding parts 18, 19 in turn remain stationary during the moving together of the die parts 9, 10.

Figure 14:
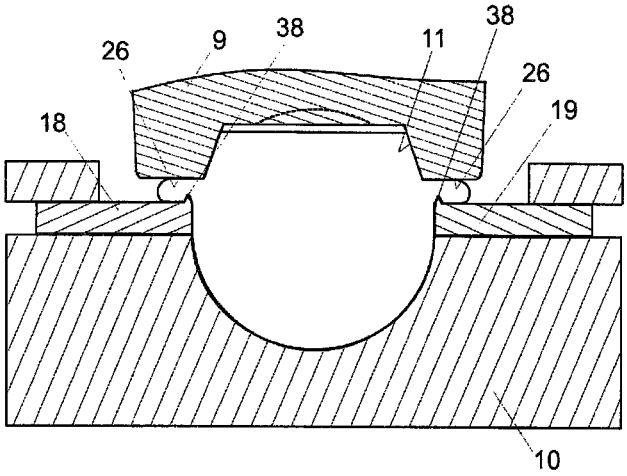
FIG. 14 shows a representation analogous to FIG. 5 of a third embodiment of the invention.

FIG. 14 shows a third exemplary embodiment, which corresponds to the first exemplary embodiment apart from a modification in the region of the secondary molding parts 18, 19. Here, the secondary molding parts 18, 19 have in the region of their ends directed toward the main cavity 14 projections 38, by which the intermediate space 42, 43 between the secondary molding parts 18, 19 and the end face 26 of the first die part 9 is reduced in the region of the projections 38. As a result, incisions are formed in the flash 32, 33, whereby detachment of the flash 32, 33 is made easier. In order to place the incisions at the starting point of the flash 32, 33 from the main body to be formed of the toothed rack 4, the secondary molding parts 18, 19 here reach further up to the main cavity 14, i.e. the end faces 22 of the secondary molding parts 18, 19 bound the main cavity. The material coming out into the second cavities passes here directly into the intermediate spaces 42, 43 lying between the secondary molding parts 18, 19 and the end face 26 (lying next to the molding recess 11) of the second die part 9. The secondary molding parts 18, 19 in turn remain stationary during the moving together of the die parts 9, 10.

A mounting of the secondary molding parts 18, 19 analogous to the second exemplary embodiment would also be possible to form such incisions. The projections 38 would then be aligned with the end face 23 of the second die part 10.

Figure 15:
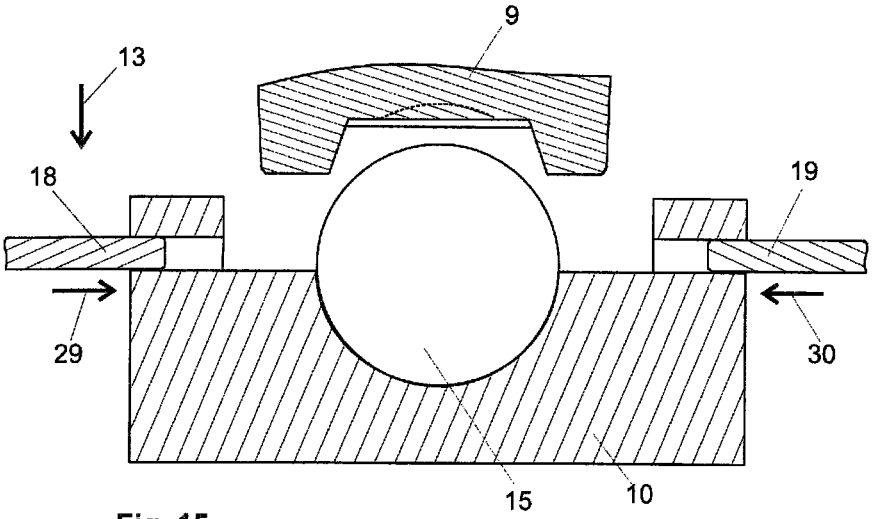
FIGS. 15 to 17 show representations analogous to FIGS. 3 to 5 of a fourth embodiment of the invention.
Figure 16:
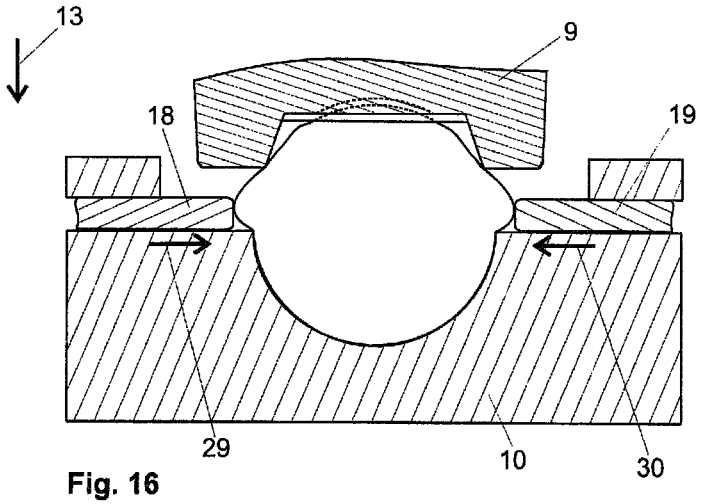
Figure 17:
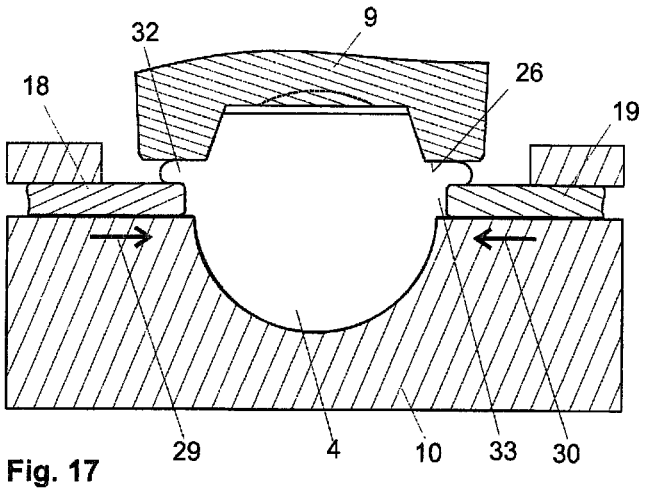

A fourth exemplary embodiment is explained on the basis of FIGS. 15 to 17. The mounting of the secondary molding parts 18, 19 corresponds to the first exemplary embodiment, represented in FIGS. 3 to 9, but could for example also correspond to the exemplary embodiment that is represented in FIGS. 10 to 13. As a difference from the exemplary embodiments described above, in this exemplary embodiment the secondary molding parts 18, 19 are moved in the respective adjusting direction 29, 30 during the moving together of the die parts 9, 10, to be precise at least also from the point in time from which displaced material of the blank 15 abuts against them (before that they may be stationary or likewise already be moved). This is also clear from the comparison of FIGS. 16 and 17. This allows the flowing of the material of the blank 15 to be influenced further. Such influencing of the material of the blank allows an optimization of the flowing processes, and consequently of the overall forging method, to be achieved, for example in order to increase once again the hydrostatic pressure in a final phase of the moving together of the die parts 9, 10. When doing so, however, material can continue to flow into the secondary cavities 16, 17, since they are at least not completely filled. At least in the final phase of the moving together of the die parts 9, 10 before reaching the moved-together end position, material of the blank 15 passes into the intermediate spaces 42, 43, which lie between the secondary molding parts 18, 19 and the end face 26 of the die part 9.

In addition to the possibilities of optimizing the flow on the device for the forging method by different geometries of the secondary molding parts 18, 19, optimizations can be carried out here by the positions and movements of the secondary molding parts 18, 19 (which at least in this exemplary embodiment may also be referred to as punches) during the forging.

The adjustment of the secondary molding parts 18, 19 may be performed by actuators that are not represented in the figures. Furthermore, a coupling with the movement of the adjustable die part 9 may take place, for example in that the movement of the die part 9 may be accompanied at the same time by adjustment of sloping faces, against which the ends of the secondary molding parts 18, 19 that are remote from the main cavity abut.

Figure 18:
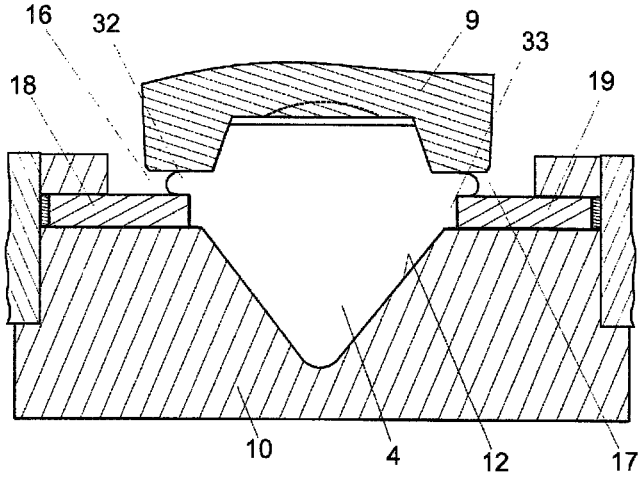
FIG. 18 shows a representation analogous to FIG. 5 of a fifth embodiment of the invention.

FIG. 18 shows a fifth exemplary embodiment, which corresponds to the first exemplary embodiment apart from the form of the molding recess 12 of the second die part 10. Here, the molding recess 12 has side faces converging in a wedge-shaped manner, whereby the back region of the toothed rack 4, lying opposite the toothing 5, is formed over the toothed portion with a corresponding form. The form of the toothed rack that is formed could also be referred to as a toothed rack with a triangular cross section.

Figure 19:
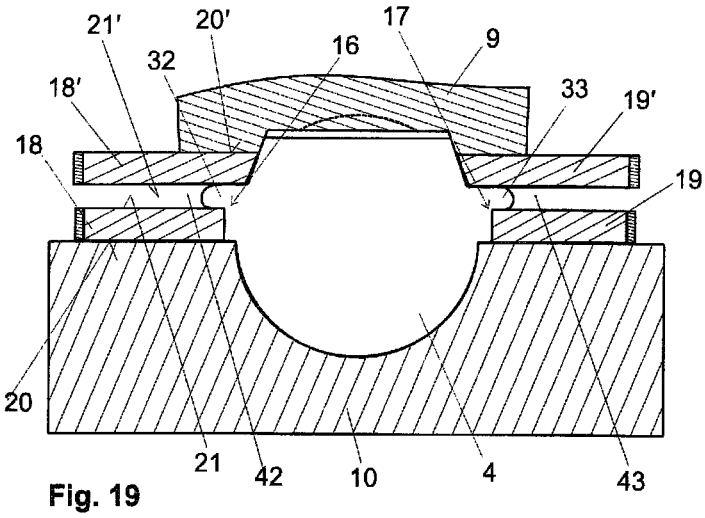
FIG. 19 shows a representation analogous to FIG. 5 of a sixth embodiment of the invention.

FIG. 19 shows a sixth exemplary embodiment, which corresponds to the first exemplary embodiment apart from the differences mentioned hereafter. Here, secondary molding parts 18, 18', 19, 19' are mounted displaceably in the adjusting directions 29, 30 both on the first die part 9 and on the second die part 10. In each case, one of the side faces 20, 20' of the secondary molding parts 18, 18', 19, 19' abuts against the respective die part 9, 10. The side faces 21, 21', respectively directed toward one another, of the secondary molding parts 18, 18' and 19, 19' that are lying on the same side of the main cavity have between them a gap, the thickness of which is reduced when the die parts 9, 10 are moved together but is not completely closed in the moved-together end position of the die parts 9, 10. At least in the final phase of the moving together of the die parts 9, 10, material of the blank 4 flows into these intermediate spaces 42, 43.

The secondary molding parts 18, 19 are drawn back from the main cavity, while the secondary molding parts 18', 19' adjoin the main cavity flush, and their end faces, inclined here, represent portions of the walls bounding the main cavities. Various modifications of this are possible; for example, all of the secondary molding parts could be drawn back from the main cavity 14. In the case of preferred embodiments, at least two of the secondary molding parts 18, 18'; 19, 19' are drawn back from the main cavity.

The displaceable mountings of the secondary molding parts 18, 18', 19, 19' on the die parts 9, 10 are not represented in FIG. 19 for the sake of simplicity. For adjustment when wear commences, stop plates 34, 34', 35, 35' could in turn be provided for example.

In further exemplary embodiments, displaceably mounted secondary molding parts could be provided only on the movable die part 9.

If secondary molding parts that are separate from the die parts 9, 10 are provided both on the fixed die part 10 and on the movable die part 9, at least the secondary molding parts that are arranged on one of the die parts 9, 10 are mounted displaceably in adjusting directions 29, 30 with respect to the die part 9, 10 in the way described; preferably, such a displaceable mounting is then provided for all of the secondary molding parts 18, 19.

In the figures, the fixed die part 10 is represented at the bottom and the blank 15 is placed into this fixed die part. An inverted arrangement, with the blank 15 being placed into the movable die part 9, is likewise possible.

In the exemplary embodiments shown, the molding recess forming the toothings is arranged in the movable die part 9. An arrangement in the fixed die part 10 is also possible.

To the extent to which they can be applied or executed, all of the different individual features of the various examples can be exchanged and/or combined with one another without departing from the scope of the invention.

Key to the reference numerals:

| | |
|---|---|
| 1 | steering wheel |
| 2 | steering shaft |
| 3 | steering pinion |
| 4 | toothed rack |
| 5 | toothing |
| 6 | steering housing |
| 7 | tie rod |
| 8 | tooth |
| 9 | first die part |
| 10 | second die part |
| 11 | first molding recess |
| 12 | second molding recess |
| 13 | closing direction |
| 14 | main cavity |
| 15 | blank |
| 16 | secondary cavity |
| 17 | secondary cavity |
| 18, 18' | secondary molding part |
| 19, 19' | secondary molding part |
| 20, 20' | first side face |
| 21, 21' | second side face |
| 22 | end face |
| 23 | end face |
| 24 | edge |
| 25 | edge |
| 26 | end face |
| 27 | edge |
| 28 | edge |
| 29 | adjusting direction |
| 30 | adjusting direction |

-continued

| Key to the reference numerals: | |
|---|---|
| 31 | edge |
| 32 | flash |
| 33 | flash |
| 34 | stop plate |
| 35 | stop plate |
| 36 | stop |
| 37 | stop |
| 38 | projection |
| 39 | longitudinal axis |
| 40 | displacing direction |
| 41 | profile |
| 42 | intermediate space |
| 43 | intermediate space |

The invention claimed is:

1. A die for forging a portion having a toothing of a toothed rack of a steering device, comprising first and second die parts, of which the first die part has a first molding recess for molding the toothing of the toothed rack, and the second die part has a second molding recess, which has a form of a back region of the toothed rack, lying opposite the toothing, and which can be moved together in a closing direction from an open position into an end position, in which the first and second die parts are at a distance (s) from one another, while shaping a blank placed into the die, wherein, in a region of the molding recesses of the die parts, there is formed between the die parts a main cavity, which in the moved-together end position of the die parts is open on opposite sides toward secondary cavities, which respectively lie in a region lying between the first and second die parts, and at least two secondary molding parts, which respectively lie in the region lying between the first and second die parts and by which walls bounding the secondary cavities are at least partially formed, the secondary molding parts are respectively displaceable with respect to the die parts in an adjusting direction oriented at an angle to the closing direction wherein between a respective one of the secondary molding parts and an end face of a respective one of the die parts, said end face is facing the other of the die parts, or between two of the secondary molding parts, there is an intermediate space, a width of which is reduced as the die parts are moved together, but is present during the whole moving together of the die parts and in the moved-together end position of the die parts.

2. The die as claimed in claim 1, wherein the adjusting direction of the respective secondary molding part forms an angle of at least 45° with the closing direction.

3. The die as claimed in claim 1, wherein, in the moved-together end position of the die parts, the secondary cavities are at least one of open toward an outside or are only partially filled with displaced material of the blank.

4. The die as claimed in claim 1, wherein a respective one of the secondary molding parts has first and second side faces, of which the first side face abuts against an end face of one of the two die parts and of which the second side face forms at least a portion of a wall bounding the respective secondary cavity.

5. The die as claimed in claim 4, wherein the first and second side faces of a respective one of the secondary molding parts are connected to one another by way of an end face, which is drawn back from the main cavity and forms a wall bounding the respective secondary cavity.

6. The die as claimed in claim 5, wherein the end face of the respective secondary molding part forms an angle of less than 45° with the adjusting direction of the respective secondary molding part.

7. The die as claimed in claim 4, wherein the end face of the die part against which the first end face of the respective secondary molding part abuts has a portion which lies between an abutting region of the first side face of the respective secondary molding part and the molding recess of the respective die part and which forms a wall bounding the respective secondary cavity.

8. The die as claimed in claim 1, wherein the at least two secondary molding parts are displaceably mounted on one of the die parts on both sides of the molding recess of the die part.

9. The die as claimed in claim 1, wherein, seen in cross section through the die, the second molding recess of the second die part has an arcuate form.

10. A forging method for forging a portion having a toothing of a toothed rack for a steering device, comprising shaping a blank between two die parts, of which the first die part has a first molding recess for molding the toothing of the toothed rack, and the second die part has a second molding recess, which has a form of a back region of the toothed rack, lying opposite the toothing, and which can be moved together in a closing direction from an open position into an end position, in which they are at a distance (s) from one another, while shaping the blank placed into the die, wherein, in a region of the molding recesses of the die parts, there is formed between the die parts a main cavity, which in the moved-together end position of the die parts is open on opposite sides toward secondary cavities, which respectively lie in a region lying between the first and second die parts, and wherein, when the die parts move together, displacing material of the blank into the secondary cavities, the material displaced into the secondary cavities abutting against secondary molding parts, which respectively partially bound a flow of the displaced material in the respective secondary cavity, and the material displaced into the secondary cavities is displaced into an intermediate space, which is arranged within the respective secondary cavity and is bounded by a face of the respective secondary molding part that is directed in a direction of one of the die parts and an end face of this die part or by a face of the respective secondary molding part that is directed in the direction of one of the die parts and a surface of a further secondary molding part, which is arranged in the same secondary cavity wherein a width of the intermediate space is reduced as the die parts are moved together, but is present during the whole moving together of the die parts and in the moved-together end position of the die parts.

11. The forging method as claimed in claim 10, wherein, in the moved-together end position of the die parts, the secondary cavities are only partially filled with the displaced material of the blank.

12. The forging method as claimed in claim 10, wherein, the secondary molding parts are displaceable mounted and during the forging of the toothed portion of the toothed rack, the secondary molding parts are kept stationary with respect to adjusting directions thereof.

13. The forging method as claimed in claim 10, wherein, during the forging of the toothed portion of the toothed rack, at least one of the secondary molding parts is adjusted in an adjusting direction.

* * * * *